United States Patent [19]

Schuettenberg

[11] Patent Number: 4,640,787

[45] Date of Patent: Feb. 3, 1987

[54] GASOLINE COMPOSITIONS CONTAINING BRANCHED CHAIN AMINES OR DERIVATIVES THEREOF

[75] Inventor: Alexander D. Schuettenberg, Bartlesville, Okla.

[73] Assignee: Phillips Petroleum Company, Bartlesville, Okla.

[21] Appl. No.: 623,069

[22] Filed: Jun. 22, 1984

Related U.S. Application Data

[63] Continuation-in-part of Ser. No. 364,361, Apr. 1, 1982.

[51] Int. Cl.[4] ..... C10M 133/16

[52] U.S. Cl. ..... 252/51.5 A; 252/392; 564/138; 564/141; 44/71

[58] Field of Search ..... 252/51.5 A, 392; 44/71; 564/138, 141

[56] References Cited

U.S. PATENT DOCUMENTS

| | | | |
|---|---|---|---|
| 2,568,472 | 9/1951 | Trautman | 252/33.6 |
| 2,758,916 | 8/1956 | Mahan | 44/69 |
| 2,830,019 | 4/1958 | Fields et al. | 252/33.6 |
| 2,954,342 | 6/1956 | Hotten | 252/32 |
| 3,173,770 | 3/1965 | Thompson et al. | 44/63 |
| 3,409,421 | 11/1968 | Belo et al. | 44/72 |
| 3,522,022 | 2/1969 | Hofheim et al. | 44/66 |
| 3,827,981 | 8/1974 | Thompson | 252/51.5 A |
| 3,838,991 | 10/1974 | Garth | 44/66 |
| 3,996,024 | 12/1976 | Coon | 252/392 |
| 4,059,535 | 11/1977 | DeVault et al. | 252/33 |
| 4,162,223 | 7/1979 | Gragson et al. | 252/33.2 |
| 4,478,604 | 10/1984 | Schuettenberg | 252/392 |

*Primary Examiner*—Jacqueline V. Howard
*Attorney, Agent, or Firm*—A. W. Umphlett

[57] ABSTRACT

Certain branched chain amines and carboxylic derivatives thereof are useful additives for lubricants and fuels.

13 Claims, No Drawings

GASOLINE COMPOSITIONS CONTAINING BRANCHED CHAIN AMINES OR DERIVATIVES THEREOF

This is a continuation in part of co-pending application Ser. No. 364,361 filed Apr. 1, 1982.

BACKGROUND OF THE INVENTION

Carburetor detergents are conventionally included in gasoline compositions along with other additives, in order to enhance engine performance. They inhibit the formation of deposits in carburetors so that the mixing of fuel and air may take place more efficiently.

THE INVENTION

The invention deals with the use of branched chain amines and derivatives thereof as additives for fuels and lubricants. The additives are rust inhibitors, corrosion inhibitors, carburetor detergents, and dispersants.

OBJECT OF THE INVENTION

One object of the invention is the provision of a method of inhibiting rust deposits in fuel storage vessels.

Another object of the invention is a method of preventing unwanted deposits in carburetors.

Still another object is the production of useful dispersant additives for lubricants.

DESCRIPTION OF THE INVENTION

It has been discovered that a certain class of compounds are useful carburetor detergents. These compounds are also efficient rust-and-corrosion-inhibitors and dispersant additives for lubricants.

AMINES

Amines which are useful in the invention are branched chain amines containing about 7 to 30 carbon atoms. They may be monoamines or multiamines having two or more amine groups. When used for rust inhibition branched chain amines of 7 to 30 carbon atoms are serviceable, but in a general characterization as detergent additive only branched chains of 8 to 30 carbon atoms having at least 7 carbon atoms in a straight chain are advantageously used.

One preferred method of making the subject amines is via the reaction of branched alkenes with unsaturated nitriles. For instance, 5,7,7-trimethyloctyl-amine may be produced by reacting diisobutylene with acrylonitrile and hydrogenating the product.

The subject amines conform to the general formula $$X—Q—NH_2$$

wherein X is —H, or —$NH_2$; and Q is an alkylene radical containing 7 to 30 carbon atoms, such that at least two carbon atoms link the X and $NH_2$ groups. Preferred amines are those wherein X is —H and from 1 to 4 of the substituents on the main chain of Q are —$CH_3$, or —$CH(CH_3)_2$ groups. Monomaines having 2 to 4 —$CH_3$ groups are preferred. Of these, 5,7,7-trimethyloctylamine and isoheptylamine are most preferred.

DERIVATIVES OF AMINES

Instead of the branched amines themselves, reaction products of these amines with substituted or unsubstituted acids can be employed. The acid useful for reaction with the subject amines contain between 1 and 12 carbon atoms. The substituent groups, when present, can be one or more hydroxyl, amino, or carboxyl groups. The substituents may be situated along the main chain of the acid or they may be on side chains.

Useful acids may be monocarboxylic, e.g., formic, acetic, or propionic; dicarboxylic, e.g., oxalic, or succinic; or polycarboxylic, e.g., tetracarboxybutane. Polycarboxylic acids containing 2 to 24 carbon atoms are preferred.

The substituted acids can have one or more hydroxyl substituents, e.g., tartaric acid; one or more amino substituents, e.g., ethylene diaminetetraacetic acid; one or more carboxyl substituents, e.g., acetoacetic acid; or combinations thereof, e.g., citric acid.

Depending upon reaction conditions, the branched amines of this invention react with various of the functional groups in the subject acids. Preferably, the amines react with the carboxyl groups to form monoamides or polyamides. These amides can contain unreacted amino, carboxyl, and/or hydroxyl groups. Where appropriate, hydrocarbyl ester or anhydride groups can be substituted for any of the carboxyl groups in the acid compounds mentioned above.

Mixtures of one or more amines and one or more amine derivatives can be employed in additive combinations. All of the additives of this invention are generally useful with automotive fuels and lubricants commonly used in automotive engines.

ADDITIVE CONCENTRATIONS

The additives of the invention whether used as amines or amine derivatives are useful in varying amounts depending upon the formulations to which they are added.

As rust inhibitors and detergents for gasolines, lubricants, or other fuel compositions, they are useful in concentrations of about 10 to 10,000 ppm. As rust inhibitors for lubricants, they are preferably used at concentrations of about 0.1 to 10% by weight.

EXAMPLE I

A Falcon Engine Test

A standard engine test for carburetor detergency was run on a fuel containing 5,7,7-trimethyloctylamine. This test showed an 83 percent reduction in carburetor deposits relative to a control with no additive. This 5,7,7-trimethyloctylamine shows excellent carburetor detergency, comparable to that shown by Phil-Ad CD (a commercially available carburetor detergent produced by Phillips Petroleum Co., Bartlesville, OK). The additive concentrations used and the resultant reductions in carburetor deposits are shown in the following table:

TABLE 1

| Additive | Amount (lb per 1000 bbl) | Reduction in Carburetor Deposits |
|---|---|---|
| 5,7,7-trimethyl-octylamine | 10 | 83% |
| PHIL-Ad CD | 10 (active component) | 89% |

The Falcon Engine Test was conducted as follows:

The additive was added to unleaded Kansas City premium base gasoline (Phillips Petroleum Co.) in the amount of 10 lbs. of additive per 1000 barrels of gasoline. The test involves the use of the test gasoline in a 170 cubic inch displacement 6 cylinder Falcon automobile engine with a removable carburetor throat insert. The engine operated 23 hours at 1800 rpm and 11.4 brake horsepower. The difference in insert weight before and after the tests corresponds to the weight of deposits. Results are compared with tests using the same base gasoline without additives to determine the percent reduction of deposits.

EXAMPLE II

Three different polyamides were prepared by reacting stoichiometric amounts of 5,7,7-trimethyloctylamine with ethylenediamine tetraacetic acid, d-tartaric acid, and oxalic acid. The products of these reactions were tested for carburetor detergency in unleaded gasoline at a concentration of 10 lbs. per 1,000 barrels. The results of a Falcon Engine test are given below:

TABLE 2

| Amine | Acid | Reduction in Carburetor Deposits |
|---|---|---|
| TOA* | EDTA** | 80% |
| TOA* | d-tartaric | 57% |
| TOA* | oxalic | 64% |

*TOA = trimethyloctylamine
**EDTA = ethylenediaminetetraacetic acid

EXAMPLE III (Comparative)

Acetic acid and tallow amine (a $C_{16-18}$ straight chain amine) were reacted. The reaction product was insoluble in Falcon test fuel and, accordingly, was not a suitable additive.

EXAMPLE IV

Formic acid was reacted with each of 5,7,7-trimethyloctylamine and isoheptylamine. These reaction products and isoheptylamine were employed in Falcon engine tests at concentrations of 10 lbs. per 1,000 barrels. The results are given in the following table.

TABLE 3

| Amine | Acid | Reduction in Carburetor Deposits |
|---|---|---|
| *TOA | Formic | 46% |
| Isoheptylamine | Formic | (41% increase) |
| Isoheptylamine | none | (43% increase)[1] |

TABLE 3-continued

| Amine | Acid | Reduction in Carburetor Deposits |
|---|---|---|
| Isoheptylamine | EDTA** | —[2] |

*TOA = trimethyloctylamine
**EDTA = ethylenediamine tetraacetic acid
[1]While isoheptylamine is not effective as a detergent, other data show it is effective as a rust inhibitor in lubricants.
[2]Not soluble in hexane, so no further tests conducted as gasoline additives.

Reasonable variations such as may occur to a skilled artisan are within the scope of this invention.

I claim:

1. A detergent additive comprising a reaction product of (a) a $C_{8-30}$ branched chain monoamine having at least 7 carbon atoms in a straight chain and (b) a $C_{1-12}$ monocarboxylic acid or ester.

2. A detergent additive of claim 1 wherein said amine is 5,7,7-trimethyloctylamine.

3. A detergent additive of claim 1 wherein the carboxylic acid employed bears a substituent selected from hydroxyl, amine, and carboxyl groups.

4. A method of inhibiting rust and corrosion in vessels containing fuels or lubricants comprising adding to the material to be store an effective amount of at least one additive selected from a reaction product of (a) a $C_{7-30}$ branched chain amine and (b) a $C_{1-12}$ monocarboxylic acid or ester.

5. The method of claim 4 wherein the amount of additive employed ranges from 10 to 10,000 ppm.

6. The method of claim 4 wherein the amine is 5,7,7-trimethyloctylamine.

7. The method of claim 4 wherein the carboxylic acid employed bears a substituent selected from hydroxyl, amine, and carboxyl groups.

8. The method of claim 5 wherein the carboxylic acid employed bears a substituent selected from hydroxyl, amine, and carboxyl groups.

9. The method of claim 7 wherein the amount of additive employed ranges from 10 to 10,000 ppm.

10. The method of claim 8 wherein the amount of additive employed ranges from 10 to 10,000 ppm.

11. A lubricant composition comprising a detergent additive of claim 1 present in a detergent effective amount.

12. A lubricant composition of of claim 11 wherein said amine is 5,7,7-trimethyloctylamine.

13. A lubricant composition of claim 11 wherein the carboxylic acid employed bears a substituent selected from hydroxyl, amine, and carboxyl groups.

* * * * *